United States Patent [19]

Koleske

[11] 4,011,639

[45] Mar. 15, 1977

[54] CLIP

[75] Inventor: Otto Koleske, Sunbury, Pa.

[73] Assignee: Wilson Manufacturing Corporation, Sunbury, Pa.

[22] Filed: Apr. 24, 1974

[21] Appl. No.: 463,807

[52] U.S. Cl. ..... 24/255 H; 132/46 A

[51] Int. Cl.[2] ..... A44B 21/00

[58] Field of Search ..... 132/46, 48; 24/255 H, 24/259 HC, 259 PF

[56] References Cited

UNITED STATES PATENTS

| | | | |
|---|---|---|---|
| 1,389,728 | 9/1921 | Akimoff | 16/150 |
| 2,460,650 | 2/1949 | Nemeta | 24/67 CF |
| 2,795,233 | 6/1957 | Zore | 132/46 R |
| 3,628,215 | 12/1971 | Everburg | 16/150 |

*Primary Examiner*—Werner H. Schroeder
*Assistant Examiner*—Doris L. Troutman
*Attorney, Agent, or Firm*—Cushman, Darby & Cushman

[57] ABSTRACT

A clip of the sort disclosed in U.S. Pat. No. 2,795,233 is further provided with two impressed slight bends respectively proceeding from the two roots of the slots between the center leg and the two outer legs to the outer end of the integral base portion, preferably with slight convergence. This elaboration increases the holding force of the clip, when closed and increases the maximum cross-sectional area of the tress which may be successfully held by the clip.

3 Claims, 3 Drawing Figures

CLIP

BACKGROUND OF THE INVENTION

The invention was devised as an improvement upon the clip disclosed in the U.S. Pat. No. 2,795,233 of Zore, issued June 11, 1957. Without using more material and with an exceedingly inexpensive additional step in manufacturing, the holding power of the clip is substantially improved.

SUMMARY OF THE INVENTION

A clip of the sort disclosed in U.S. Pat. No. 2,795,233 is further provided with two impressed slight bends respectively proceeding from the two roots of the slots between the center leg and the two outer legs to the outer end of the integral base portion, preferably with slight convergence. This elaboration increases the holding force of the clip, when closed and increases the maximum cross-sectional area of the tress which may be successfully held by the clip.

By preference, the bend lines are impressed by stamping or rolling, i.e. without the removal of material and leaving the clip substantially as thick in the roots of the bends as in the surrounding remainder of the clip.

The principles of the invention will be further hereinafter discussed with reference to the drawing wherein a preferred embodiment is shown. The specifics illustrated in the drawing are intended to exemplify, rather than limit, aspects of the invention as defined in the claims.

DETAILED DESCRIPTION OF THE PRESENTLY PREFERRED EMBODIMENT OF THE INVENTION

The teaching in U.S. Pat. No. 2,795,233 remains essentially true of the improved clip 10 disclosed herein, this reference and allegation saving the need to repeat what is there recorded and presently available to the public.

In brief, the clip 10, which is preferably formed of high carbon steel or stainless steel so that the grain of the sheet proceeds transversally of the clip.

Figure 1:
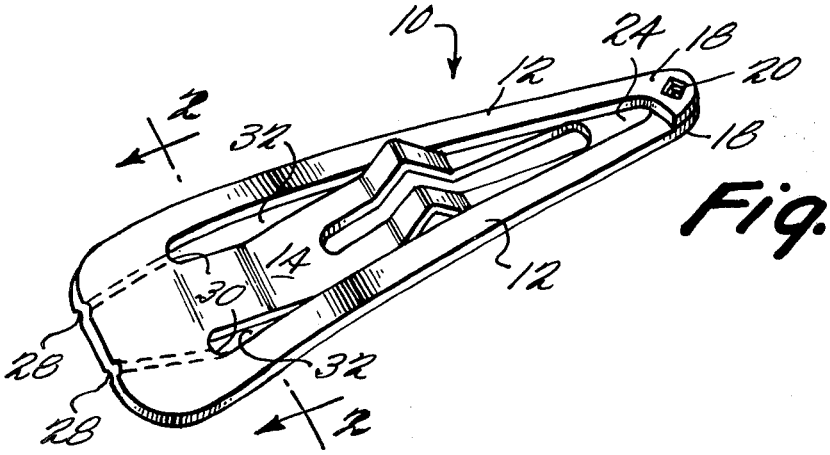
FIG. 1 is a perspective view of the clip of the invention in a closed condition.
Figure 2:
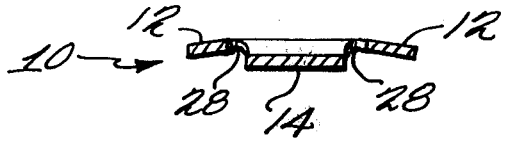
FIG. 2 is a transverse cross-sectional view taken on line 2—2 of FIG. 1.
Figure 3:
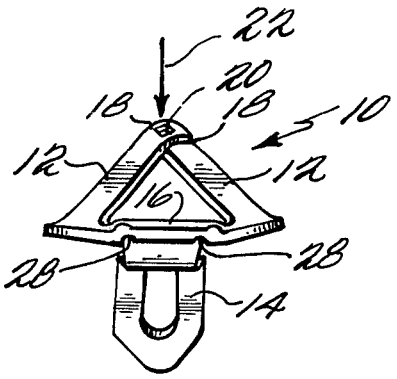
FIG. 3 is an end elevational view of the clip in an open condition.

The clip includes two outer legs 12 which flank a center leg 14 with which they share a common base 16. The distal ends 18 of the outer legs are brought together and fastened at 20, giving the resulting outer leg assembly 22 a propensity to bow to a concave-convex condition. When the outer leg assembly is in the condition of FIG. 3, the outer leg assembly curves from the base 16 away from the center leg 14. However, by pushing on the outer leg assembly in the vicinity and direction of the arrow 22, the assembly will snap over center to, become concave-convex in the reverse sense, the condition depicted in FIG. 1. In the FIG. 1 condition, the distal end of the outer leg assembly not only engages the distal end 24 of the center leg 14, but resiliently bears thereagainst, flexing the center leg somewhat. This produces a force tending to maintain the clip center leg engaged with the outer leg assembly near their respective distal ends.

To use the clip 10 to hold a tress of hair, the clip 10 is snapped open (FIG. 3), the hair inserted between the center leg 14 and the outer leg assembly, and the clip 10 is then snapped closed (FIG. 1), with the tress of hair engaged between the center leg and outer leg assembly.

In contrast to clip of the aforementioned prior U.S. Pat. No. 2,795,233 wherein the clip base is essentially plain, the base 16 of the clip 10 of the present invention is provided with two impressed slight bends, creases or grooves 28 which respectively proceed from the two roots 30 of the slots 32 between the center leg 14 and the two outer legs 12 to the outer end 34 of the base 16, preferably with slight convergence as illustrated. The grooves 28 are formed by rolling or stamping, by preference and cause a relatively discontinuous change in direction of the surfaces of the base 16, and not principally any significant change in either the amount of material or the thickness of the base within the grooves in comparison with the remainder of the base. The grooves 28 are applied on the face 34 of the clip 10 which is toward the viewer when the center leg 14 of the clip is positioned to snap open toward the viewer.

It should be noticed that, seen in transverse section, the base 16 changes from being concave on its grooved face when the clip is closed to being convex on that face when the clip is open.

The intention is providing the grooves is to provide the clip with more tension tending to hold the clip closed so it will successfully hold a larger tress of hair and/or hold the tress more securely. This opens a number of options to the manufacturer or user. For instance, if the clip is made of the same gauge and quality of material as previously, the user may set hair with fewer clips by dividing the hair into fewer but larger tresses. Without using more material, or significantly adding to manufacturing or merchandising expense, the manufacturer can truthfully promote the clips as improved, due to their increased holding capability. Or, to save manufacturing expense, the clips may be made of slightly thinner or lower quality sheet steel or the like, yet have as adequate holding capability as previously.

As an example, two clips were made of 0.015 gauge stainless steel with the patented Zore invention aforementioned. The bends were made by stamping between two bars and a platen, the bars having the substantially same edge sharpness as a Rockwell 41 C hardness tester, the two bends 28 an aggregate length of 0.500 inch, and a pressing force of 25 Ton pounds. The bend lines converged toward the end 34 by 2°. In all respects but for the provision of the bend lines, the two clips were intentionally substantially identical. However, the clip without impressed bend lines tended to spring open when one attemped to close it about a one-fourth inch diameter cylindrical metal pin (simulating a hair tress), but the clip 10 provided with impressed bend lines 28 would securely close about that pin and appeared to have a gripped thickness limit near five-sixteenths inch. In another test, the two clips respectively supported were by the joined ends of their outer legs and the outer ends of the bases 16, weights were hung from the same points on their respective center legs with the clips in a closed position. As the amounts of the weights hanging from the center legs were increased, the older-style clip opened at weights averaging 608 grams and the clip of the invention, provided with impressed bend lines 28 opened at valves averaging 670 grams pressure, a betterment of more than 10 percent. The present invention was worked out in association with a business enterprise which has been making clips in accordance with the teachings of the aforesaid Zore patent for over a decade and a half, during which time more than 100 million of these clips have been made. Needless to say, the improvement was surprising.

It should now be apparent that the clip as described hereinabove possesses each of the attributes set forth in the specification under the heading "Summary of the Invention" hereinbefore. Because the clip of the invention can be modified to some extent without departing from the principles of the invention as they have been outlined and explained in this specification, the present invention should be understood as encompassing all such modifications as are within the spirit and scope of the following claims.

I claim:

1. A clip, comprising:

a piece of flexible sheet material having a common base portion at one end; a center leg projecting from the base; and two outer legs projecting from the base in the same general direction as the center leg and flanking the center leg at the base; means connecting the outer legs together in laterally stressed condition, distally of the base, with the outer legs, as a corollary to their being connected, being maintained closer together distally of the base than the width of the center leg at the same distance from the base, whereby the outer legs and base assume a concavo-convex condition which may be snapped to a reverse concavo-convex condition in order to bring the center and outer legs, distally of the base, alternatively into resilient mutual engagement, i.e. a "closed" condition, and substantial separation, i.e. an "open" condition;

said clip being provided with the improvement wherein: said base, on the face thereof from which the center leg curves toward the observer when the clip is in said open condition, being provided with two impressed bend lines which respectively proceed from where the two outer legs flank one another and join the base and extend generally longitudinally and generally parallel to one another across the base to the opposite extent of the base, the impressed bend lines being sufficiently strongly impressed as to produce visually apparent changes in the spatial disposition of the base on opposite flanks of each bend line.

2. The clip of claim 1 wherein the impressed bend lines converge as they extend toward the opposite extent of the base by about 2°.

3. The clip of claim 2 wherein the flexible sheet material is sheet steel oriented with the grain thereof proceeding transversally of the clip.

* * * * *